US011320788B2

(12) United States Patent
Stranczl

(10) Patent No.: US 11,320,788 B2
(45) Date of Patent: May 3, 2022

(54) STRIKING OR MUSICAL WATCH WITH AN ACOUSTIC WAVEGUIDE ARRANGEMENT

(71) Applicant: Montres Breguet S.A., L'Abbaye (CH)

(72) Inventor: Marc Stranczl, Nyon (CH)

(73) Assignee: Montres Breguet S.A., L'Abbaye (CH)

( * ) Notice: Subject to any disclaimer, the term of this patent is extended or adjusted under 35 U.S.C. 154(b) by 192 days.

(21) Appl. No.: 16/750,762

(22) Filed: Jan. 23, 2020

(65) Prior Publication Data

US 2020/0264565 A1 Aug. 20, 2020

(30) Foreign Application Priority Data

Feb. 14, 2019 (EP) ..... 19157246

(51) Int. Cl.
*G04B 21/08* (2006.01)
*G04B 23/02* (2006.01)
*G04B 37/00* (2006.01)

(52) U.S. Cl.
CPC ..... *G04B 21/08* (2013.01); *G04B 23/028* (2013.01); *G04B 37/0075* (2013.01)

(58) Field of Classification Search
CPC .. G04B 21/08; G04B 23/028; G04B 37/0075; G04B 23/12; G04B 21/06; G04B 37/08
USPC ..... 368/243
See application file for complete search history.

(56) References Cited

U.S. PATENT DOCUMENTS

| | | | | |
|---|---|---|---|---|
| 7,742,365 | B2 * | 6/2010 | Moteki | G04B 23/10 368/269 |
| 8,770,833 | B2 * | 7/2014 | Sciascia | G04G 17/02 368/315 |
| 9,164,487 | B1 * | 10/2015 | Raggi | G04B 21/02 |
| 9,360,843 | B2 * | 6/2016 | Kadmiri | G04B 37/087 |
| 2010/0111333 | A1 | 5/2010 | Dinnissen et al. | |
| 2011/0019508 | A1 | 1/2011 | Behling et al. | |
| 2012/0002513 | A1 | 1/2012 | Behrend et al. | |
| 2016/0109855 | A1 | 4/2016 | Kadmiri et al. | |
| 2017/0212475 | A1 | 7/2017 | Niwa et al. | |

FOREIGN PATENT DOCUMENTS

| | | |
|---|---|---|
| CH | 701 549 A2 | 1/2011 |
| CH | 710227 A2 | 4/2016 |
| CN | 1214966 A | 4/1999 |

(Continued)

OTHER PUBLICATIONS

Communication dated Feb. 2, 2021, from the Japanese Patent Office in application No. 2020008130.

(Continued)

*Primary Examiner* — Edwin A. Leon
(74) *Attorney, Agent, or Firm* — Sughrue Mion, PLLC

(57) ABSTRACT

A striking or musical watch with an acoustic waveguide arrangement. The striking or musical watch (1) includes an at least partially flexible waveguide (2) secured to a fixed part (8) inside the watch to guide the acoustic waves generated by a first portion (2') of the at least partially flexible waveguide towards a radiating element. The radiating element can include a watch crystal (3) connected to a bezel (5) and a membrane (4) for connecting the bezel to a middle part (6) of a watch case. The flexible waveguide is configured to change the direction of acoustic vibration from the first portion to the radiating element.

21 Claims, 2 Drawing Sheets

(56) References Cited

FOREIGN PATENT DOCUMENTS

| | | | |
|---|---|---|---|
| CN | 101382771 | A | 3/2009 |
| CN | 101738928 | A | 6/2010 |
| CN | 101933341 | A | 12/2010 |
| CN | 102356362 | A | 2/2012 |
| CN | 102692867 | A | 9/2012 |
| CN | 105487370 | A | 4/2016 |
| CN | 105527816 | A | 4/2016 |
| EP | 2 738 625 | A1 | 6/2014 |
| EP | 3 009 895 | B1 | 6/2017 |
| ER | 2 199 877 | A1 | 6/2010 |
| FR | 2 777 095 | A1 | 10/1999 |
| JP | 2014513309 | A | 5/2014 |
| JP | 2017134058 | A | 8/2017 |

OTHER PUBLICATIONS

European Search Report issued in EP 19 15 7246 dated Aug. 14, 2019.

Communication dated Feb. 23, 2021, from The State Intellectual Property Office of the P.R. of China in Application No. 202010092298.9.

* cited by examiner

STRIKING OR MUSICAL WATCH WITH AN ACOUSTIC WAVEGUIDE ARRANGEMENT

CROSS-REFERENCE TO RELATED APPLICATIONS

This application claims priority to European Patent Application No. 19157246.0, filed Feb. 14, 2019, the entire contents of which are incorporated herein by reference.

FIELD OF THE INVENTION

The invention concerns a striking or musical watch comprising an acoustic waveguide arrangement.

BACKGROUND OF THE INVENTION

In the field of horology, a watch can be provided with a striking mechanism for indicating minute repeaters or for producing music at predefined moments. In the case of a striking mechanism using gongs, the metal gong or gongs used are generally circular in shape and placed in a plane parallel to the watch dial. One end or several ends of each gong are secured to at least one gong-carrier integral with the main plate of the watch movement or with the watch case middle. The other end of each gong can generally move freely. The vibration of each gong is produced by the impact of a corresponding hammer on the gong in proximity to the gong-carrier. Each hammer generally makes a partial rotation in the plane of the gong(s) in order to strike the corresponding gong and cause it to vibrate in-plane parallel to the back cover or dial of the watch. Part of the gong vibration is also transmitted to the plate by the gong-carrier or to other parts of the watch, such as the external parts.

When a sound is emitted in a watch with a striking mechanism, there is a vibration source, such as a gong or a vibration plate, which creates a mechanical vibration in the plane of the watch, and a radiating element, such as an acoustic membrane, which transforms the mechanical vibration produced by the vibration source into a variation in air pressure. The gong is not generally directly connected to the radiating element, such as the acoustic membrane. By way of comparison, reference can be made to a loudspeaker with the moving coil as the vibration source, which creates a mechanical vibration, and the acoustic membrane as the radiating element, which transforms the mechanical vibration into a variation in air pressure, The moving coil is connected, i.e. directly fixed, to the radiating element.

In the case of a watch, a vibration transmission element can consist of the plate, a casing ring, the case middle, a bezel gasket, for example, but these are not components optimized for the transmission of vibrations. As indicated above, the external parts of the watch are, for example, the case middle, the bezel, the crystal or the back cover of the case. When a sound is produced either by a gong struck by a hammer, or by one or more strips of a vibrating plate, these vibrations have to propagate from the area where they were created, for example by the gong or the vibration plate, to the area where they are required to radiate the sound, for example a membrane or a watch crystal.

In a conventional striking watch, the acoustic efficiency, based on the complex vibro-acoustic transduction of the external parts, is low. The vibration from a gong, which is a vibration-generating element, does not propagate properly to the external parts, which are a sound-radiating element. To improve and increase the acoustic level perceived by the user of the striking watch, it is necessary to improve the transmission of vibrations to better transmit them to the element that radiates. Account must be taken of the material, geometry and boundary conditions of said external parts. The configurations of these external parts are also dependent on the aesthetics of the watch and operating constraints, which may limit possibilities of adaptation.

To improve the radiation of a sound generated by a gong or the strips of a vibrating plate, one or more membranes can also be used, arranged inside the watch case as described in EP Patent No. 3 009 895 B1. These membranes are configured to improve the acoustic radiation of the sound or music produced. Other external watch parts may also be adapted to produce good sound radiation, particularly at low frequencies. However, the acoustic efficiency of all these arrangements is often insufficient, which constitutes a drawback.

SUMMARY OF THE INVENTION

It is thus an object of the invention to overcome the drawbacks of the state of the art by providing a striking or musical watch with a good waveguide arrangement for acoustic waves produced inside the watch to ensure good radiation of the sound or melody generated inside the watch to the outside of the watch. Improved transmission of mechanical vibrations is achieved by means of the waveguide arrangement.

The invention therefore concerns a striking or musical watch described above, which includes the features defined in the independent claim 1.

Specific embodiments of the watch are defined in the dependent claims 2 to 19.

One advantage of the striking or musical watch according to the invention lies in the fact that it comprises an at least partially flexible waveguide connected to a fixed part of the watch in order to guide the acoustic waves between a first portion of the guide and a radiating element. The at least partially flexible waveguide is configured to change the direction of acoustic vibration from a first portion, which is a location for generating or receiving acoustic waves, to a radiating element. This makes it possible to switch from a mode of vibration in the plane of the watch to a 'piston' type out-of-plane vibration mode.

Advantageously, a radiating element is a watch crystal, or a watch crystal connected to a bezel to be secured to the middle part of a watch case. Preferably, a bellows-type membrane is placed between the bezel and the middle part. Thus, the radiating element moves freely to function like a loudspeaker (out-of-plane). This improves the quality and intensity of the sound or melody perceived outside the watch.

BRIEF DESCRIPTION OF THE DRAWINGS

The objects, advantages and features of the striking or musical watch comprising an acoustic waveguide arrangement will appear more clearly in the following description, particularly with reference to the drawings, in which.

DETAILED DESCRIPTION OF THE INVENTION

In the following description, all those elements of the striking or musical watch comprising an acoustic waveguide arrangement, which are well known in this technical field, will be only briefly described.

Figure 1:
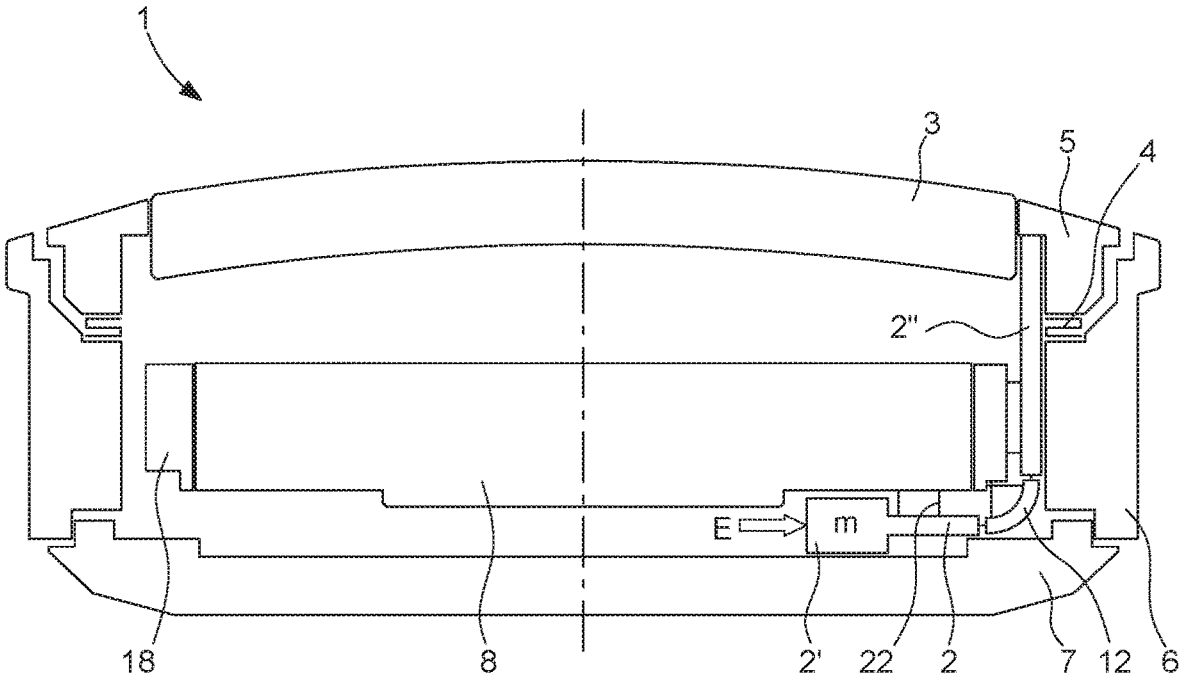
FIG. 1 is a simplified cross-sectional view of a striking or musical watch with an acoustic waveguide arrangement according to a first embodiment of the invention.

FIG. 1 schematically represents a cross-section of a striking or musical watch 1, which includes an arrangement for guiding acoustic waves inside the watch to improve the quality and intensity of the sound or melody perceived outside the watch, particularly at predefined moments when the watch is used.

Figure 2:
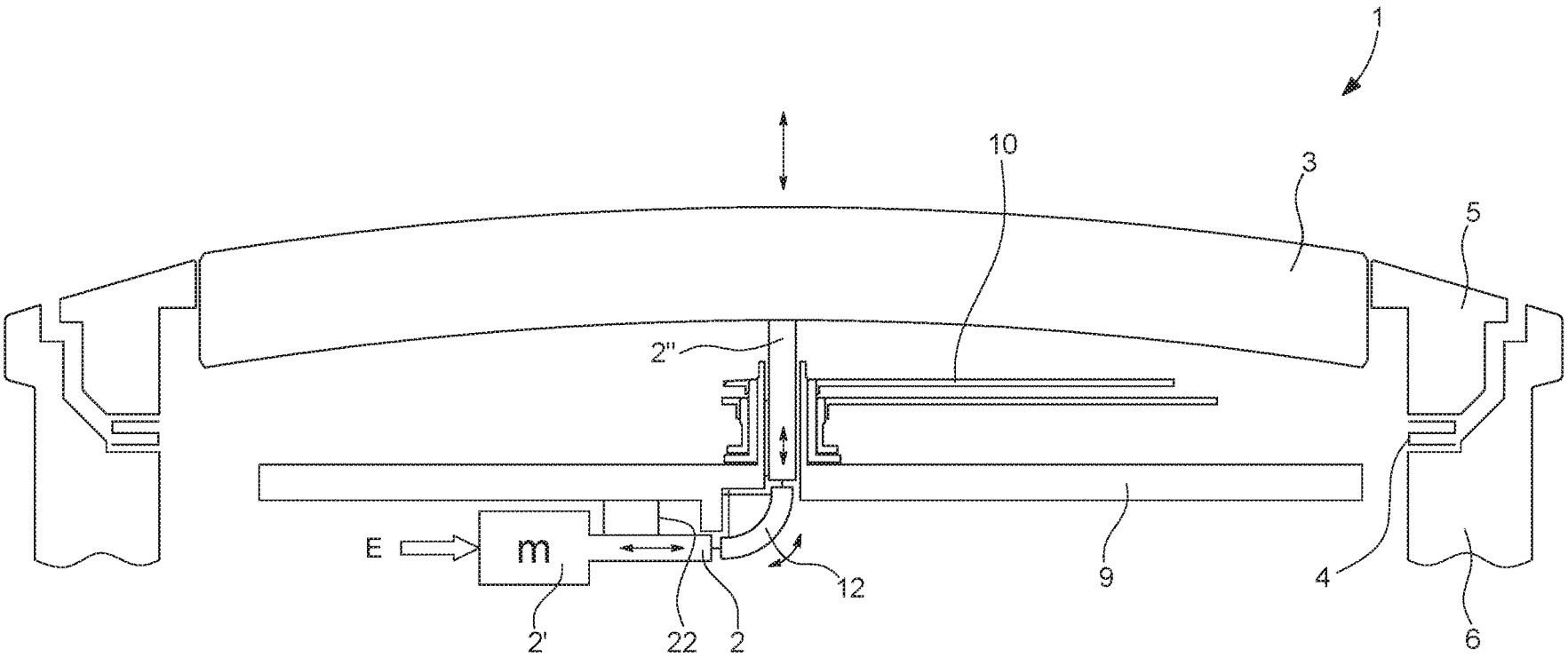
FIG. 2 is a simplified partial cross-sectional view of a striking or musical watch with an acoustic waveguide arrangement according to a second embodiment of the invention.

Striking or musical watch 1 mainly comprises an at least partially flexible waveguide 2, which is secured to a fixed part 8 inside watch 1, for example to a plate of the watch movement or to a middle part 6 of a watch case 1 or to an inner support, such as a casing ring, or to a watch dial 9, as shown in FIG. 2. The at least partially flexible waveguide 2 guides the generated acoustic waves through a first portion 2' of flexible waveguide 2 towards a radiating element 3, 4, 5. Once secured to the aforementioned fixed part, at least partially flexible waveguide 2 is configured to change the direction of acoustic vibration from first portion 2' to the radiating element.

In the first embodiment shown in FIG. 1, at least partially flexible waveguide 2 is held on a rectilinear part on the side of its first portion 2', which may be a first end of the guide, by flexible strips 22, for example, under the plate of watch movement 8. This rectilinear part on first portion 2' may be rigid. The at least partially flexible waveguide 2 further comprises a curved part 12 for the change in direction of acoustic vibration and another rectilinear part 2" connecting curved part 12 to radiating element 3, 4, 5. At least curved part 12 is on a flexible guide member. This other rectilinear part is also secured to the fixed part, for example to a fixed wall 18 above the plate by other flexible strips. The fixed wall may be a casing ring 18, but other connecting means can be provided.

The at least partially flexible waveguide 2 is in one piece with flexible strips 22, since any contact in the transmission of vibrations reduces the sound transmission quality.

A second portion 2" of the other rectilinear part of the at least partially flexible waveguide 2 comes into contact with or is connected to the radiating element, which can be directly a watch crystal 3, or a bezel 5 connected to watch crystal 3, as represented in FIG. 1. This other rectilinear part on second portion 2" may also be rigid. The radiating element can also be connected by a bellows membrane 4 to hold crystal 3, or preferably crystal 3 with bezel 5, on a middle part 6 of watch case 1, which is also closed by a back cover 7 on the other side. This membrane 4 may be cylindrical in shape in order to close the watch case in a sealed manner with bezel 5 connected to crystal 3. The radiating element is thus free to move and function like a loudspeaker (out-of-plane) by means of membrane 4 added between bezel 5 and case middle 6.

It is also possible to envisage not having second portion 2" but having curved part 12 directly connected to the radiating element.

Another radiating element can be envisaged, such as a membrane fixed inside the watch case on back cover 7 side, or directly back cover 7 of the watch case.

It is to be noted that membrane 4 is made of metal or amorphous metal material. This membrane 4 can be made by electroforming and can have a relatively complex geometry.

In this first embodiment of FIG. 1, the acoustic waves may be generated by an excitation element E, such as a hammer, which strikes at the first end, which in this case is first portion 2', of the at least partially flexible waveguide 2. The hammer strikes a vibration source once, which may be directly the at least partially flexible waveguide 2 or a gong that vibrates for a certain time after the hammer strikes. This generation of acoustic waves is firstly with a vibration in the plane of the watch, i.e. parallel to a plate of watch movement 8 or parallel to a watch dial. Then, curved part 12 of at least partially flexible waveguide 2 changes the direction of acoustic vibration to make radiating element 3, 4, 5 vibrate at second portion 2", which may be a second end, of at least partially flexible waveguide 2. The acoustic vibration in this case is in a 'piston' mode, like a loudspeaker, which is particularly efficient for transmitting a sound or melody. However, the directions of wave generation and wave transmission are not limiting.

The at least partially flexible waveguide 2 is thus bent along its length at its curved part 12 at an angle of more than 10 degrees and preferably at an angle of between 80 and 100 degrees, for example 90 degrees, between first portion 2' and second portion 2" of at least partially flexible waveguide 2. This makes it possible to switch from a mode of vibration in the plane of the watch to a 'piston' type out-of-plane vibration mode, which is the preferred objective.

It is to be noted that the invention also covers any change in direction of more than 10° in a three-dimensional space, and it is also possible to transform a rotation into a linear displacement.

If the at least partially flexible waveguide 2 is used directly for the generation of acoustic waves without using a gong, with the waveguide itself as the gong, it must be made of a particular material with a well-defined mass m between first portion 2' and second portion 2" of the at least partially flexible waveguide. The resonance frequency depends directly on the stiffness and mass of the guide in accordance with the equation $f_r=(1/2\pi)\cdot(k/m)^{1/2}$, where k defines the stiffness and m defines the mass. By adapting mass m of the at least partially flexible waveguide, a precise generated note can be determined and transmitted following the strike of hammer E. The mass of at least partially flexible waveguide 2 can easily be adjusted by filing off part of the at least partially flexible waveguide or by adding or removing weight screws, for example.

It is also to be noted that hammer E can strike flexible waveguide 2 anywhere, since at least partially flexible waveguide 2 is capable of transmitting the generated acoustic vibration.

It is also possible to envisage connecting a resonant member, such as a gong (not represented) of a striking mechanism to first portion 2' or the first end of at least partially flexible waveguide 2. In such case, the hammer strikes the gong and the acoustic waves generated by the vibrating gong are guided by first portion 2' of the at least partially flexible waveguide. The gong can also be placed in intermediate portions of at least partially flexible waveguide 2.

A vibration plate with strips (not represented) of a striking mechanism can also be provided and placed in contact with first portion 2' of at least partially flexible waveguide 2. The vibration plate can be actuated by the excitation element, which is a disc or cylinder with pins for exciting the strips of the striking mechanism at predetermined moments to generate acoustic waves in the form of a melody. The acoustic waves generated as a melody are guided by first portion 2' of at least partially flexible waveguide 2.

It is to be noted that, when using a vibration plate with strips, for example at least 3 or 4 strips for generating 3 or 4 different notes, several at least partially flexible waveguides can be provided, each connected to one of the respective strips for the guidance of acoustic waves adapted to each generated note.

For security purposes, when the watch is not being used, radiating element 3, 4, 5 can be locked by a mechanical locking device to protect flexible membrane 4.

FIG. 2 schematically represents a cross-section of a striking or mechanical watch 1, which includes an arrangement for guiding acoustic waves inside the watch according to a second embodiment. For the sake of simplicity, the description of those elements presented and described with reference to FIG. 1 is not repeated.

The essential difference of this second embodiment compared to the first embodiment is that second portion 2" of at least partially flexible waveguide 2 comes into contact with or strikes crystal 3 or is directly fixed to crystal 3 of the radiating element. Preferably, at least partially flexible waveguide 2 is connected to a fixed part, which, in this case, is watch dial 9 or the plate. First portion 2' of at least partially flexible waveguide 2 is connected by flexible strips 22, for example metal strips, to an inner surface of dial 9. The curved or bent part 12 is in the centre of dial 9, for example at the centre of circular dial 9. The other rectilinear part with second portion 2" of the flexible waveguide passes through an aperture at the centre of the dial and preferably through the arbor(s) of time indicating hands 10. A connection via flexible strips in the dial aperture is also provided to hold the other rectilinear part of at least partially flexible waveguide 2.

It is also possible to envisage placing the acoustic waveguide arrangement with the mechanism visible, for example at the periphery, to allow for the passage of hands 10.

As indicated above, curved part 12 of flexible waveguide 2 changes the direction of acoustic vibration to make the radiating element vibrate at second portion 2", which may be a second end, of at least partially flexible waveguide 2. Preferably, the angle between the rectilinear part of first portion 2' and the rectilinear part of second part 2" of at least partially flexible waveguide 2 is between 80 degrees and 100 degrees, for example a right angle.

According to the configuration of the second embodiment, acoustic waves could also be generated by an excitation element E, such as a hammer, which strikes at the first end, which, in this case, is first portion 2' of at least partially flexible waveguide 2. Of course, it is also possible for at least one striking mechanism gong, for example, to be connected to first portion 2' and struck by a hammer E to generate acoustic waves guided from first portion 2' of at least partially flexible waveguide 2 to second portion 2" of at least partially flexible waveguide 2, connected to watch crystal 3.

As in the first embodiment, the radiating element comprises a watch crystal 3 or preferably the watch crystal 3 secured at the edge to a bezel 5, which is mounted on middle part 6 of the watch case via bellows membrane 4.

Figure 3:
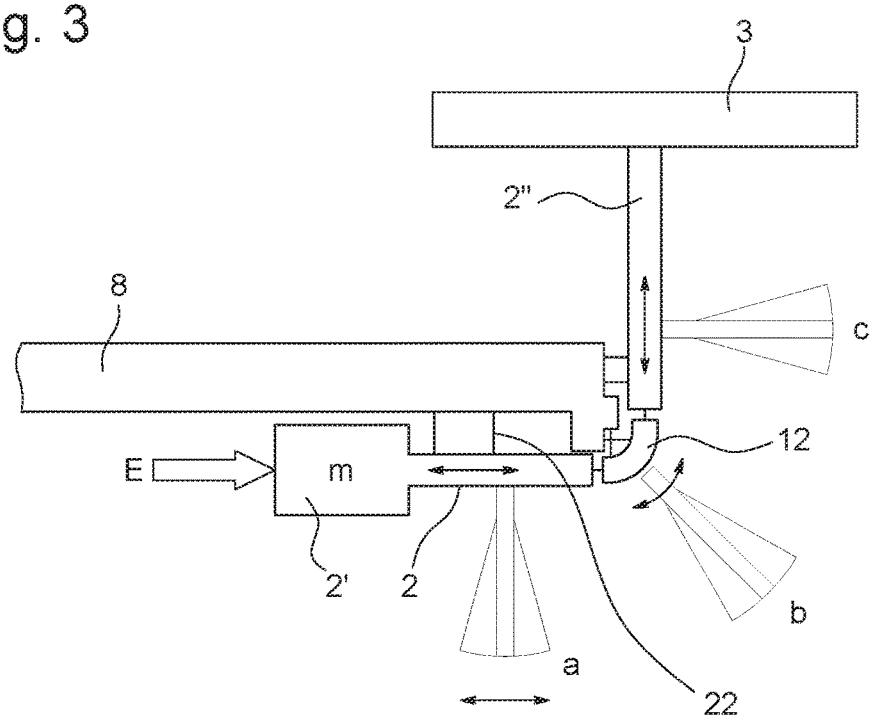
FIG. 3 is a simplified partial cross-sectional view of a striking or musical watch related to the first embodiment of FIG. 1 showing different connection positions of a resonant member to the at least partially flexible waveguide according to the invention.

FIG. 3 represents a variant of striking or musical watch 1 relating to the first embodiment of FIG. 1. For the sake of simplicity, the description of those elements presented and described with reference to FIG. 1 is not repeated.

An excitation element E, such as a hammer, can strike first portion 2' of at least partially flexible waveguide 2 and the generated acoustic waves are guided into at least partially flexible waveguide 2. A resonant member, such as a striking mechanism gong, can be connected in intermediate portions a, b, c of at least partially flexible waveguide 2 also to generate acoustic waves guided into at least partially flexible waveguide 2 after the hammer has struck first portion 2'. Such a gong (symbolically represented) can be positioned at 'a' on mechanical excitation element E, or at 'b' on curved part 12, or at 'c' on radiating element 3. The gong starts to vibrate following the acoustic vibration generated by the hammer at first portion 2' of at least partially flexible waveguide 2.

The at least partially flexible waveguide 2 can be made by wire cutting technology, by electrodeposition or made from silicon. The material must also be adapted to have good fatigue resistance.

From the description that has just been given, several variants of the striking or musical watch with the acoustic waveguide arrangement can be devised by those skilled in the art without departing from the scope of the invention defined by the claims. The at least partially flexible waveguide can take different forms but must be capable of changing the direction of acoustic vibration from the first end to the second end thereof.

The invention claimed is:

1. A musical or striking watch, comprising an at least partially flexible waveguide secured to a fixed part inside the watch to guide generated acoustic waves through a first portion of the at least partially flexible waveguide towards a radiating element, wherein the at least partially flexible waveguide is configured to change the direction of acoustic vibration from the first portion, or a first end of the flexible waveguide, to the radiating element placed at a second end of the at least partially flexible waveguide.

2. The watch according to claim 1, wherein the at least partially flexible waveguide is in one piece.

3. The watch according to claim 1, wherein said watch includes a resonant member capable of being made to vibrate by an excitation element at determined moments to generate acoustic waves supplied to the first portion of the at least partially flexible waveguide or in intermediate portions of the at least partially flexible waveguide.

4. The watch according to claim 1, wherein the at least partially flexible waveguide can be excited in its first portion by an excitation element to generate acoustic waves guided inside the at least partially flexible waveguide.

5. The watch according to claim 1, wherein the at least partially flexible waveguide can be excited in its first portion by an excitation element, and a resonant member is connected in intermediate portions of the at least partially flexible waveguide to generate acoustic waves guided inside the at least partially flexible waveguide.

6. The watch according to claim 1, wherein the mass of the at least partially flexible waveguide is adapted to a resonance frequency of the acoustic waves to be guided inside the at least partially flexible waveguide.

7. The watch according to claim 1, wherein the radiating element is a watch crystal, or a watch crystal connected to a bezel.

8. The watch according to claim 1, wherein the radiating element is a back cover or a middle part of a watch case.

9. The watch according to claim 7, wherein the radiating element further comprises a membrane for holding the crystal or the crystal with the bezel on a middle part of a watch case.

10. The watch according to claim 7, wherein a second portion of the at least partially flexible waveguide is directly connected to the radiating element.

11. The watch according to claim 7, wherein a second portion of the at least partially flexible waveguide comes into contact with the radiating element for the transmission of acoustic waves.

12. The watch according to claim 10, wherein the second portion of the at least partially flexible waveguide is connected to the bezel of the radiating element.

13. The watch according to claim 10, wherein the second portion of the at least partially flexible waveguide is connected to or in contact with the centre of the crystal of the radiating element by passing through the centre of a watch dial.

14. The watch according to claim 11, wherein the second portion of the at least partially flexible waveguide is connected to or in contact with the centre of the crystal of the radiating element by passing through the centre of a watch dial.

15. The watch according to claim 10, wherein the at least partially flexible waveguide is connected to the fixed part, which is a plate of the watch movement or a middle part of a watch case or an inner support, such as a casing ring, or a watch dial.

16. The watch according to claim 11, wherein the at least partially flexible waveguide is connected to the fixed part, which is a plate of the watch movement or a middle part of a watch case or an inner support.

17. The watch according to claim 3, wherein the resonant element is at least one gong of a striking mechanism in contact with the first portion of the at least partially flexible waveguide, and wherein the gong can be struck by the excitation element which is a hammer of the striking mechanism at predetermined moments to generate acoustic waves.

18. The watch according to claim 3, wherein the resonant member is a vibration plate with strips of a striking mechanism in contact with the first portion of the at least partially flexible waveguide, and wherein the vibration plate can be actuated by the excitation element which is a disc or cylinder with pins for exciting the strips of the striking mechanism at predetermined moments to generate acoustic waves in the form of a melody.

19. The watch according to claim 1, wherein the at least partially flexible waveguide is intended to be made from a material adapted for good fatigue resistance by a wire cutting technology, by electrodeposition or made from silicon.

20. The watch according to claim 1, wherein the at least partially flexible waveguide is curved at an angle of more than 10 degrees between the first portion and the second portion of the at least partially flexible waveguide so as to switch from a mode of vibration in the plane of the watch to a piston-type out-of-plane vibration mode.

21. The watch according to claim 1, wherein the at least partially flexible waveguide is curved at an angle of between 80 and 100 degrees between the first portion and the second portion of the at least partially flexible waveguide so as to switch from a mode of vibration in the plane of the watch to a piston-type out-of-plane vibration mode.

* * * * *